US011857046B2

(12) United States Patent
Zabloski

(10) Patent No.: US 11,857,046 B2
(45) Date of Patent: Jan. 2, 2024

(54) PERSONAL ORNAMENT CONTAINER WITH CRADLE THAT PIVOTS FOR OBJECT PRESENTATION UPON OPENING

(71) Applicant: KELO DESIGNS INC., Calgary (CA)

(72) Inventor: Matthew James Zabloski, Calgary (CA)

(73) Assignee: KELO DESIGNS INC., Calgary (CA)

( * ) Notice: Subject to any disclaimer, the term of this patent is extended or adjusted under 35 U.S.C. 154(b) by 212 days.

(21) Appl. No.: 17/677,030

(22) Filed: Feb. 22, 2022

(65) Prior Publication Data

US 2022/0304437 A1 Sep. 29, 2022

(30) Foreign Application Priority Data

Mar. 29, 2021 (CA) ..... CA 3113444

(51) Int. Cl.
*A45C 11/16* (2006.01)
*A45C 13/02* (2006.01)
*A45C 13/04* (2006.01)

(52) U.S. Cl.
CPC ..... *A45C 11/16* (2013.01)

(58) Field of Classification Search
CPC ..... A45C 11/16; A45C 13/02
USPC ..... 40/1.5, 124.06, 124.07, 124.191, 306, 40/310, 323, 324, 405, 446, 454, 493, 40/541, 591, 638, 653, 654.01, 714, 722, 40/724, 726, 797, 800, 910, 911, 912; 53/53, 136.1, 153, 204, 234, 244, 252, 53/372.9, 415, 447, 459, 475, 534, 540, 53/543, 566, 567; 63/1.11, 15.5, 15.6, 63/15.65, 33; 74/107, 109, 22 A, 22 R, 74/3.52, 3.54, 329, 330, 333, 335, 337.5, 74/340, 359, 473.11, 473.12, 473.16, 74/473.36, 567, 569, 57, 606 R, 625,
(Continued)

(56) References Cited

U.S. PATENT DOCUMENTS 10,315,836 B2 6/2019 Zabloski
2013/0313258 A1* 11/2013 Sines ..... B65D 83/0083 220/780
2019/0119035 A1* 4/2019 Zabloski ..... B65D 9/02

FOREIGN PATENT DOCUMENTS

CN 106805588 A * 6/2017 ..... A47F 7/02
CN 206714533 U * 12/2017 ..... A45F 7/02
(Continued)

*Primary Examiner* — Anthony D Stashick
*Assistant Examiner* — Marcos Javier Rodriguez Molina
(74) *Attorney, Agent, or Firm* — ATMAC Patent Services Ltd.; Andrew T. MacMillan

(57) ABSTRACT

A container includes a base and a shell rotatably coupled. The shell defines an aperture and a cradle is rotatably mounted therein. The top of the cradle holds an object and the cradle is pivotable between presentation and storage positions. An actuatable member is movable to open or occlude the aperture. Rotation of the base relative to the shell, in a first direction, drives the actuatable member towards an open position and pivots the cradle towards the presentation position, and rotation in a second direction drives the actuatable member towards a closed position and pivots the cradle towards the storage position. A lever pin on the cradle extends through a C-slot of an inner mechanism rotating with the base to a channel on the shell. Rotation between the base and shell causes the channel to drive the lever pin to different ends of the C-slot to thereby pivot the cradle.

20 Claims, 13 Drawing Sheets

(58) Field of Classification Search
USPC .... 74/665 G, 665 GE, 665 K, 813 C, 813 R, 74/89.38, 99 R; 84/2, 280, 313, 379, 84/387 A, 421, 422.1, 453; 108/50.12
See application file for complete search history.

(56) References Cited

FOREIGN PATENT DOCUMENTS

| | | | | | | |
|---|---|---|---|---|---|---|
| CN | 206714533 | U | | 12/2017 | | |
| CN | 209628867 | U | * | 11/2019 | ..... | A45C 11/16 |
| GB | 629334 | A | * | 5/1947 | ..... | A45C 11/16 |
| GB | 2539188 | A | * | 12/2016 | ..... | A45C 11/16 |

* cited by examiner

PERSONAL ORNAMENT CONTAINER WITH CRADLE THAT PIVOTS FOR OBJECT PRESENTATION UPON OPENING

CROSS-REFERENCE TO RELATED APPLICATIONS

This application claims the benefit of priority of Canadian Patent Application No. 3,113,444 filed Mar. 29, 2021, which is incorporated herein by reference.

BACKGROUND OF THE INVENTION

(1) Field of the Invention

The invention pertains generally to personal ornament containers such as jewelry boxes. More specifically, the invention relates to a container that utilizes one or more mechanical arrangements for presenting and storing objects.

(2) Description of the Related Art

Objects such as rings, bracelets, brooches, jewels, pendants, watches, necklaces and the like are often provided in an accompanying box that is intended to store and display the personal ornament in an attractive manner. Conventional personal ornament boxes often feature a clam-shell design with a hinge connecting a first segment and a second segment. The hinge is typically equipped with a means for biasing the first segment and the second segment together in a closed configuration and a means for biasing the first segment and the second segment apart in an open configuration. Generally, the closed configuration is used for storing the personal ornament, and the open configuration is used for displaying the personal ornament.

The act of switching the personal ornament box between the closed configuration and the open configuration is often an important part of presenting a personal ornament, and yet conventional personal ornament boxes are not configured to accentuate this act. In short, they do little to draw attention to their contents during presentation.

U.S. Pat. No. 10,315,836 granted on Jun. 11, 2019 and entitled "METHODS, USES, AND APPARATUS FOR PRESENTING AND STORING OBJECTS" (hereinafter "the '836 patent") is a prior design by the inventor of the present application. The '836 patent discloses a container that stores an object, such as a personal ornament, on a moveable carriage. The container is movable between a storage position and a presentation position. In the storage position, the carriage is lowered within the container and an actuatable member of the container is closed. In the presentation position, the carriage is raised relative to the storage position and the actuating member of the container opens to reveal the carriage and the object mounted thereon.

Although the design of the '836 patent works well, the inventor has found that the raising and lowering of the carriage as disclosed in the '836 patent necessitates a certain height to the container to facilitate this up and down movement. There are, however, certain situations where it would be beneficial to have a personal ornament box that is not as tall as required by the '836 patent while still providing an attractive mechanical presentation of the object stored within. One example of a situation where this may be beneficial is a surprise wedding proposal. A person planning to propose may wish to carry the engagement ring within a container concealed in a jacket pocket until the time is right. Flatter containers are easier and more comfortable to store in a pocket. Furthermore, different consumer preferences are better met by having a variety of ornament containers of different designs. Thus, there is a need for a personal ornament box having a different presentation mechanism than disclosed in the '836 patent.

BRIEF SUMMARY OF THE INVENTION

According to an exemplary embodiment of the invention there is disclosed an apparatus for presenting and storing an object. The apparatus includes a base and a shell with a first end and a second end. The first end is rotatably coupled to the base such that the shell is rotatable relative to the base about a central axis, and the second end defines an aperture about the central axis opposite to the base. A cradle is rotatably mounted within the shell and has a top side including means for removably attaching the object to the top side of the cradle. The cradle is pivotable between a presentation position where the top side of the cradle faces toward the aperture and a storage position where the top side of the cradle does not face toward the aperture. An actuatable member is adjacent the aperture and movable between a closed position in which the actuatable member at least partially occludes the aperture, and an open position in which the actuatable member does not occlude at least part of the aperture. Rotation of the base relative to the shell, in a first direction, drives the actuatable member towards the open position and pivots the cradle towards the presentation position, and rotation of the base relative to the shell, in a second direction, drives the actuatable member towards the closed position and pivots the cradle towards the storage position.

An exemplary advantage of an exemplary embodiment of the container is pivoting action of the cradle not only accentuates the presentation of the item stored therein but also facilitates making the container having a reduced vertical height, which may be particularly beneficially to situations such as surprise proposals and other gifts where the container stays concealed in a person's pocket until needed.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof.

DETAILED DESCRIPTION

Figures 1, 2:
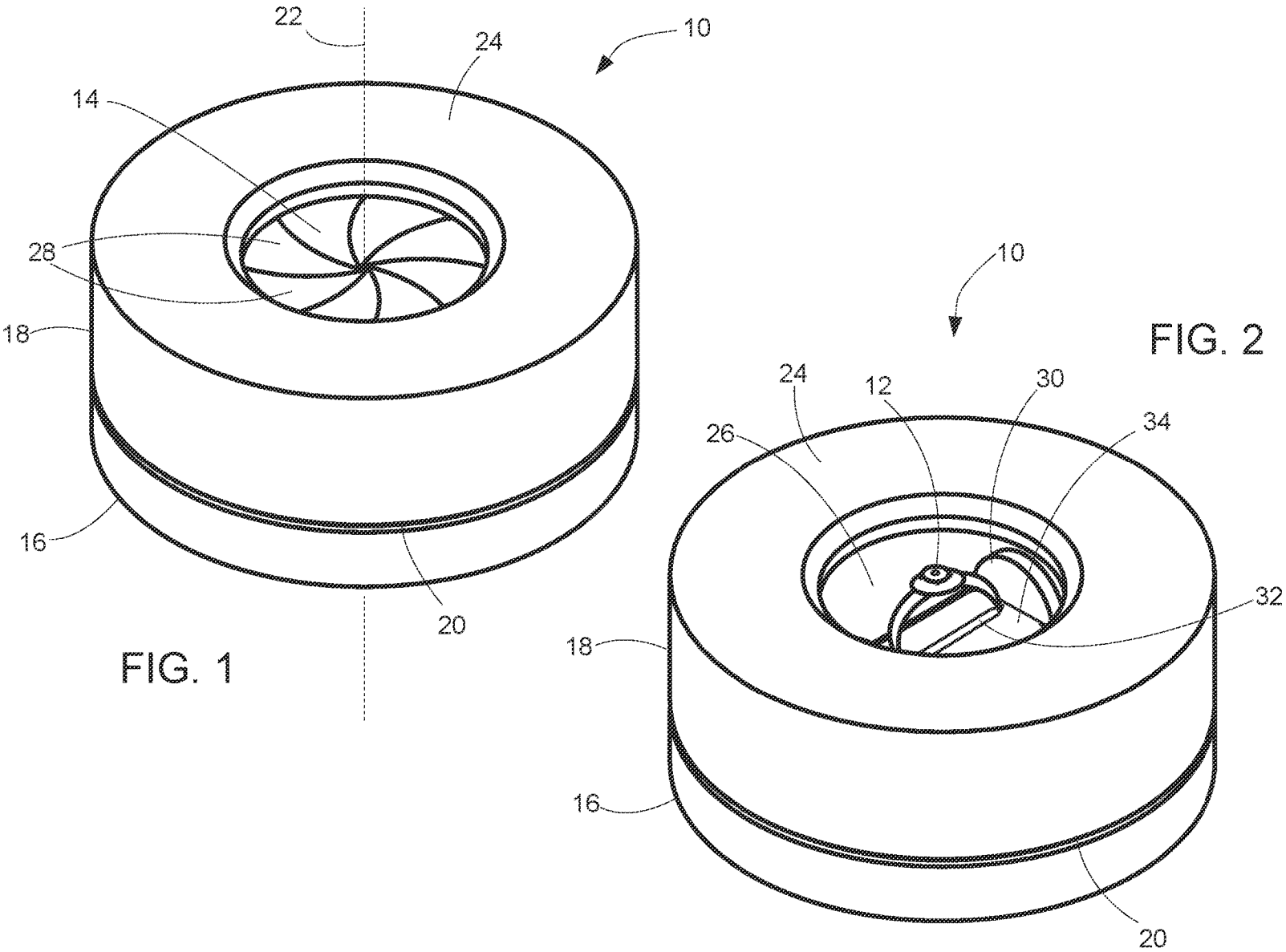
FIG. 1 shows an apparatus being a container for presenting and storing an object wherein an actuatable member of the container is in a closed position according to an exemplary embodiment.
FIG. 2 shows the apparatus of FIG. 1 with the actuatable member in an open position according to an exemplary embodiment.

FIG. 1 shows an apparatus 10 being a container for presenting and storing an object 12, such as a personal ornament, wherein an actuatable member 14 is in a closed position according to an exemplary embodiment. The apparatus 10 includes a base 16 and a shell 18 where a bottom end 20 of the shell 18 is rotatably coupled to the base 16 such that the base 16 and shell 18 can be rotated relative to one another. The container 10 of this embodiment is substantially cylinder-shaped and the center axis 22 of the cylinder shape is also the axis of rotation of the base 16 and the shell 18. The shell 18 further includes a top side 24 defining an aperture 26 around the center axis 22 and an actuatable member 14 includes a plurality of blades 28 that overlap with each other to form an iris diaphragm that in the closed position occludes the aperture 26.

FIG. 2 shows the apparatus 10 of FIG. 1 with the actuatable member 14 in an open position. As illustrated, in the open position, the aperture blades 28 are retracted by the relative motion between the base 16 and the shell 18 such that the blades 28 are moved to not occlude the aperture 26. In the open position illustrated in FIG. 2, the container 10 is open and an object 12 such as a ring or other jewelry or personal ornament is presented via a cradle 30 visible through the aperture 26. The cradle 30 of this embodiment includes a compartment formed by a slit 32 into a flexible foam material forming a top side 34 of the cradle 30. The object 12 to be presented is inserted into the slit 32 and held secure by frictional forces of the flexible foam material of the cradle 30.

Figure 3:
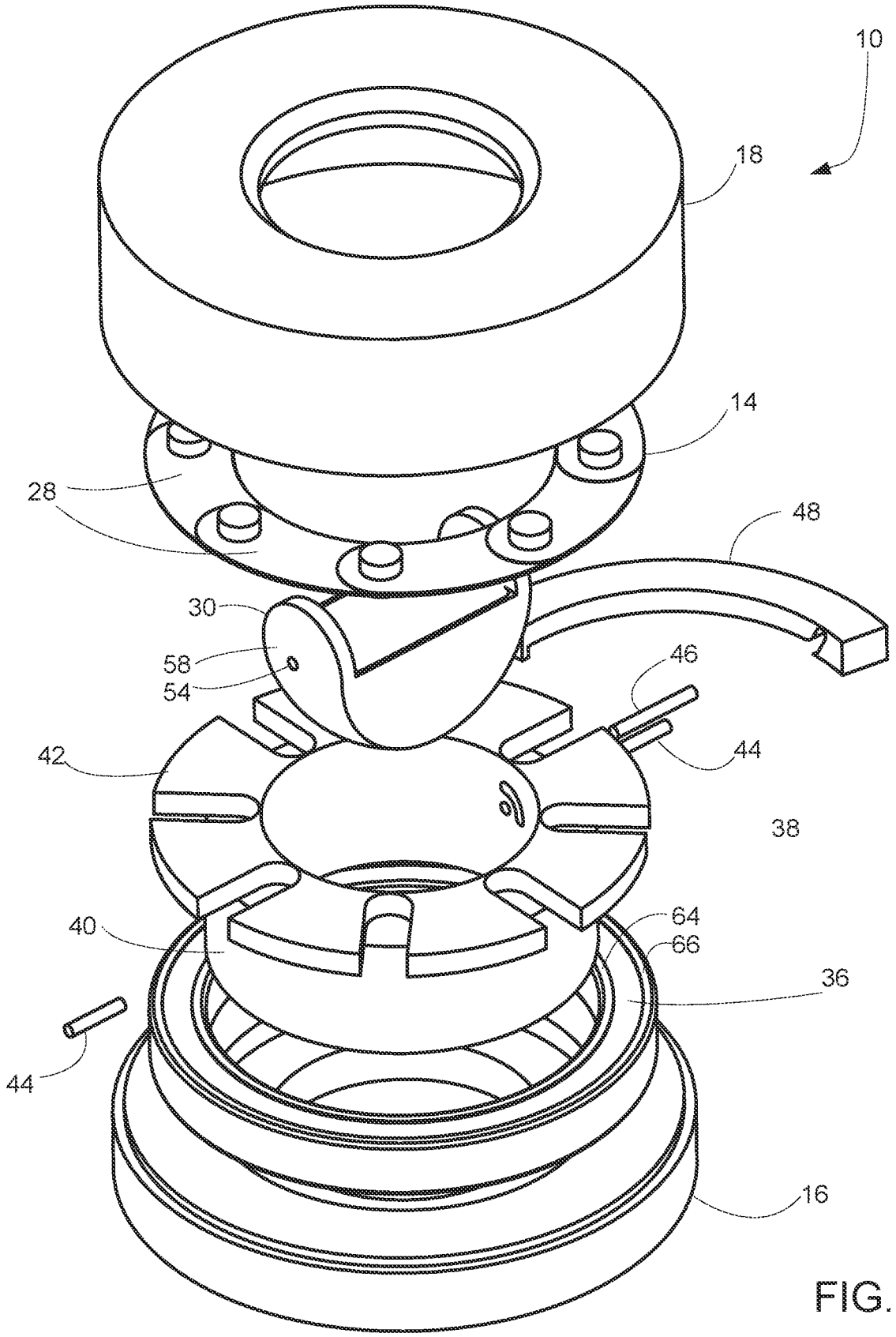
FIG. 3 shows an exploded view of components forming the apparatus of FIG. 1 according to an exemplary embodiment.

FIG. 3 shows an exploded view of the components forming the apparatus 10 of FIG. 1 according to an exemplary embodiment. The components include the base 16, a ball bearing 36, an inner mechanism 38 having a cylindrical body 40 and upper annulus 42, the cradle 30, two cradle pivot pins 44, one cradle lever pin 46, a channel member 48, a plurality of eight iris blades 28 forming the actuatable member 14, and the shell 18.

Figure 4:
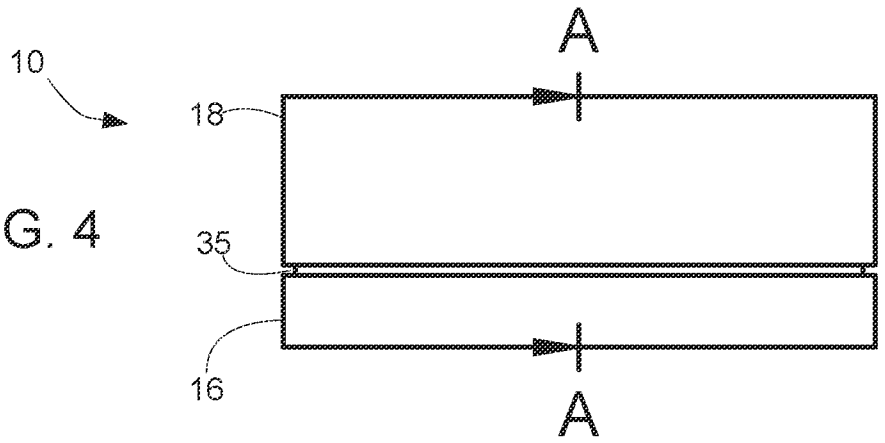
FIG. 4 illustrates a side view of the apparatus of FIG. 1.

FIG. 4 illustrates a side view of the apparatus 10 of FIG. 1. As shown, the shell 18 sits atop the base 16. The base 16 in this embodiment includes a small indent 35 around the upper portion of the base 16. This is included for firstly for aesthetics. It helps to visually break up the connection between the wood shell 18 and aluminum base 16. Further, the indent 35 provides some 'room for error' because the wood shells 18 may be sanded by hand and may therefore rarely be exactly the same diameter as the base 16. The little indent 35 allows for a slight variance in diameter between the shell 18 and the base 16 without that variance looking like an error.

Figure 6:
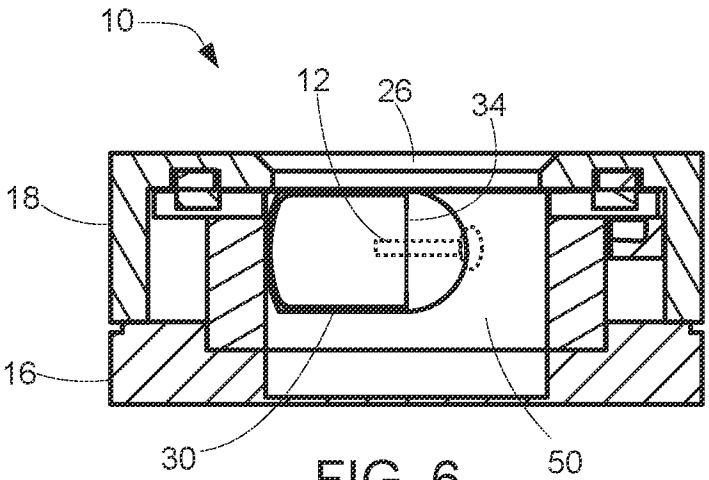
FIG. 6 illustrates a cross section of the apparatus taken across a plane parallel to the plane indicated A-A in FIG. 4 with the cradle pivoted in a closed position according to an exemplary embodiment.
Figure 5:
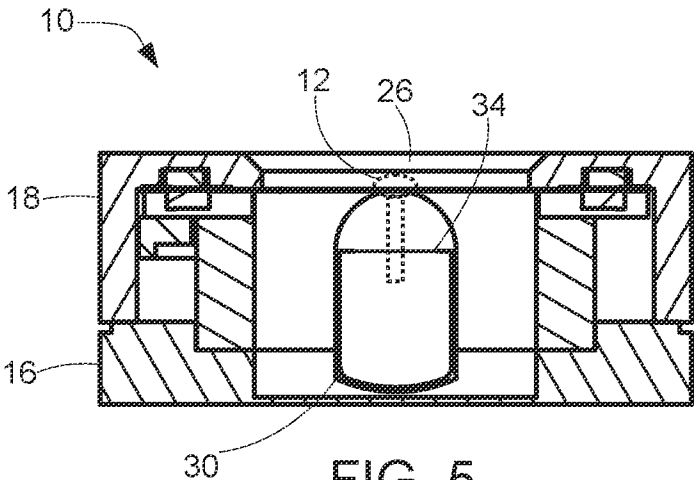
FIG. 5 illustrates a cross section of the apparatus taken across a plane parallel to the plane indicated A-A in FIG. 4 with the cradle pivoted in a presentation position according to an exemplary embodiment.

FIGS. 5 and 6 illustrate how the cradle 30 is pivotable between a presentation position where the top side 34 of the cradle 30 faces toward the aperture 26 and a storage position where the top side 34 of the cradle 30 does not face toward the aperture 26. In particular, FIG. 5 illustrates a cross section of the apparatus 10 taken across a plane parallel to the plane indicated A-A in FIG. 4 with the cradle 30 pivoted in a presentation position, and FIG. 6 illustrates a cross section of the apparatus 10 taken across a plane parallel to the plane indicated A-A in FIG. 4 with the cradle 30 pivoted in a closed position.

As shown in FIG. 5, in the presentation position, the cradle 30 is rotated such that the top side 34 of the cradle 30 and the ring 12 attached thereto is presented to a user via the aperture 26. The presentation position of the cradle shown in FIG. 5 corresponds to and occurs simultaneously with the open position of the actuatable member 14 shown in FIG. 2. Alternatively, when the actuatable member 14 is in the closed position as illustrated in FIG. 1, the cradle 30 is rotated ninety degrees into the storage position as shown in FIG. 6. In this way, the ring 12 is held within an interior volume of the apparatus 10 and does not impede the aperture blades 28 from moving to occlude the aperture 26.

Figure 7:
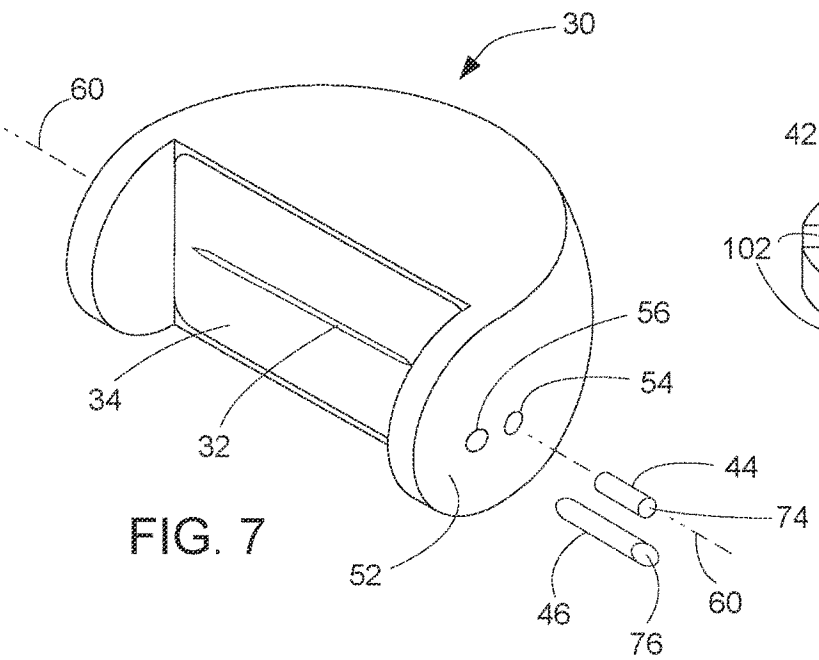
FIG. 7 illustrates a perspective view of a dual-hole side of the cradle that includes two pin holes according to an exemplary embodiment.

FIG. 7 illustrates a perspective view of a dual-hole side 52 of the cradle 30 that includes two pin holes 54, 56. A pivot hole 54 is provided on both the dual-side side 52 and a single-hole side 58 of the cradle 30 (see the single-hole side 58 of the cradle 30 having only the pivot hole 54 in FIG. 3) and pivot pins 44 are inserted into the pivot holes 54 on either side 52, 58 to thereby form a cradle axis of rotation 60 running through the line formed by the pivot pins 44. Further, at least one side 52, 58 of the cradle 30 has a lever pin hole 56 for accepting a lever pin 46. The lever pin 46 extends parallel to the pivot pin 44 but is off the axis of rotation 60 such that lateral forces applied to the lever pin 46 act to pivot the cradle 30 around the cradle's axis of rotation 60.

Figure 8:
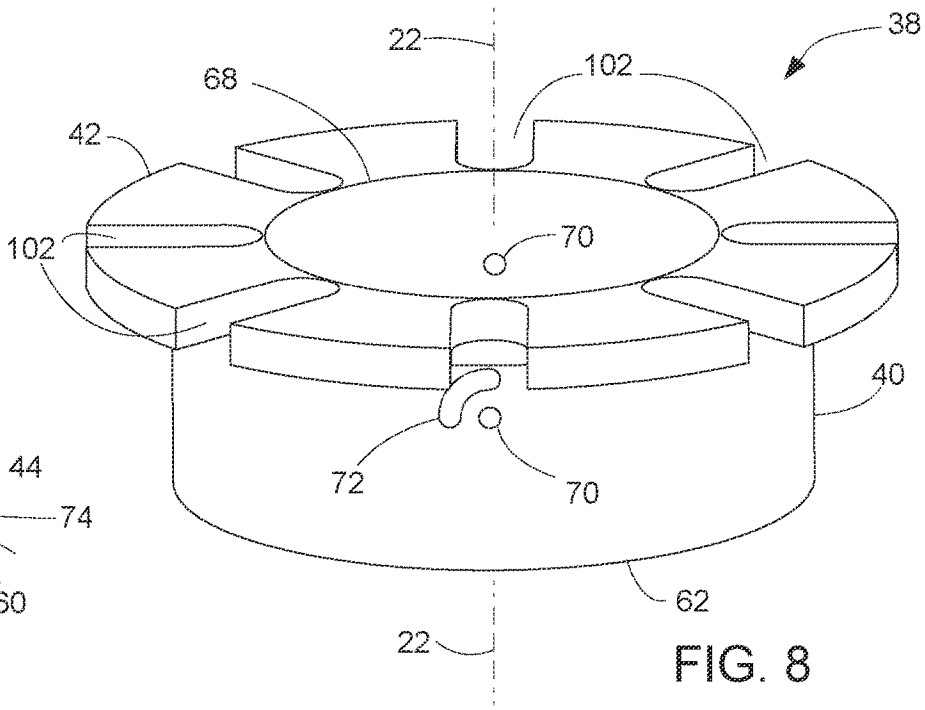
FIG. 8 illustrates the inner mechanism of the apparatus of FIG. 1 according to an exemplary embodiment.

FIG. 8 illustrates the inner mechanism 38 of the apparatus of FIG. 1 according to an exemplary embodiment. The inner mechanism 38 includes a cylindrical body 40 having a bottom end 62 for affixing to an inner race 64 of the ball bearing 36 (see FIG. 3) and a top end 68 that includes an annulus 42 flaring radially from the top end 68 around the center axis 22. The cylindrical body 40 has two pivot holes 70 for accepting and rotatably holding captive the pivot pins 44 of the cradle 30. The cylindrical body 40 further includes a C-slot 72 being an arc that traverses a portion of a circle around the pivot hole 70 on at least one side of the inner mechanism 38. The pivot pin 44 of the cradle 30 goes into the pivot hole 70 on the cylindrical body 40, and the lever pin 46 of the cradle 30 on that same side passes through the C-slot 72.

In this embodiment, as illustrated in FIG. 7, the pivot pins 44 are shorter than the lever pin 46. The length of the pivot pin 44 is such that the pivot pin 44 passes into the pivot hole 70 on the cylindrical body 40 of the inner mechanism 38 but an outwards-extending end 74 of the pivot pin 44 (see FIG.

7) is at most flush with the outer sidewall of the cylindrical body 40. In this embodiment, the pivot pin 44 does not extend past the outer sidewall of the cylindrical body 40. In contrast, the lever pin 46 is longer than the pivot pin 44 such that the outwards-extending end 76 of the lever pin 46 both passes through the C-slot 72 and further extends outwards a distance past the outer sidewall of the cylindrical body 40 for engaging a channel 78, described next.

Figure 9:
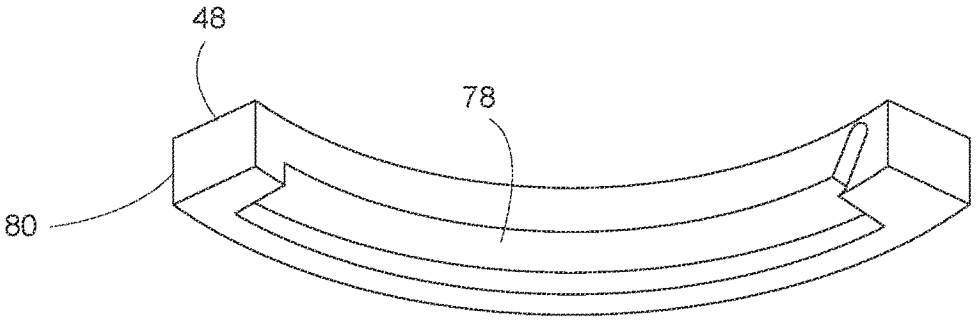
FIG. 9 illustrates a curved channel member for defining a channel according to an exemplary embodiment.

FIG. 9 illustrates a curved channel member 48 for defining a channel 78 according to an exemplary embodiment. An outside surface 80 of the curved channel member is mounted with adhesive to an inner sidewall of the shell 18 such that the channel 78 is fixed in position relative to the shell 18. Since the channel member 48 is mounted to the shell 18 and the inner mechanism 38 is mounted to the base 16, as relative motion around the center axis 22 occurs between the base 16 and shell 18, the same relative motion occurs between the channel 78 and the inner mechanism 38. The interplay between the lever pin 46 extending through the C-slot 72 of the inner mechanism 38 and forces exerted on said lever pin 46 by the channel 78 controls and drives the rotation of the cradle 30 between the storage position (FIG. 6) and the presentation position (FIG. 5).

Figure 10:
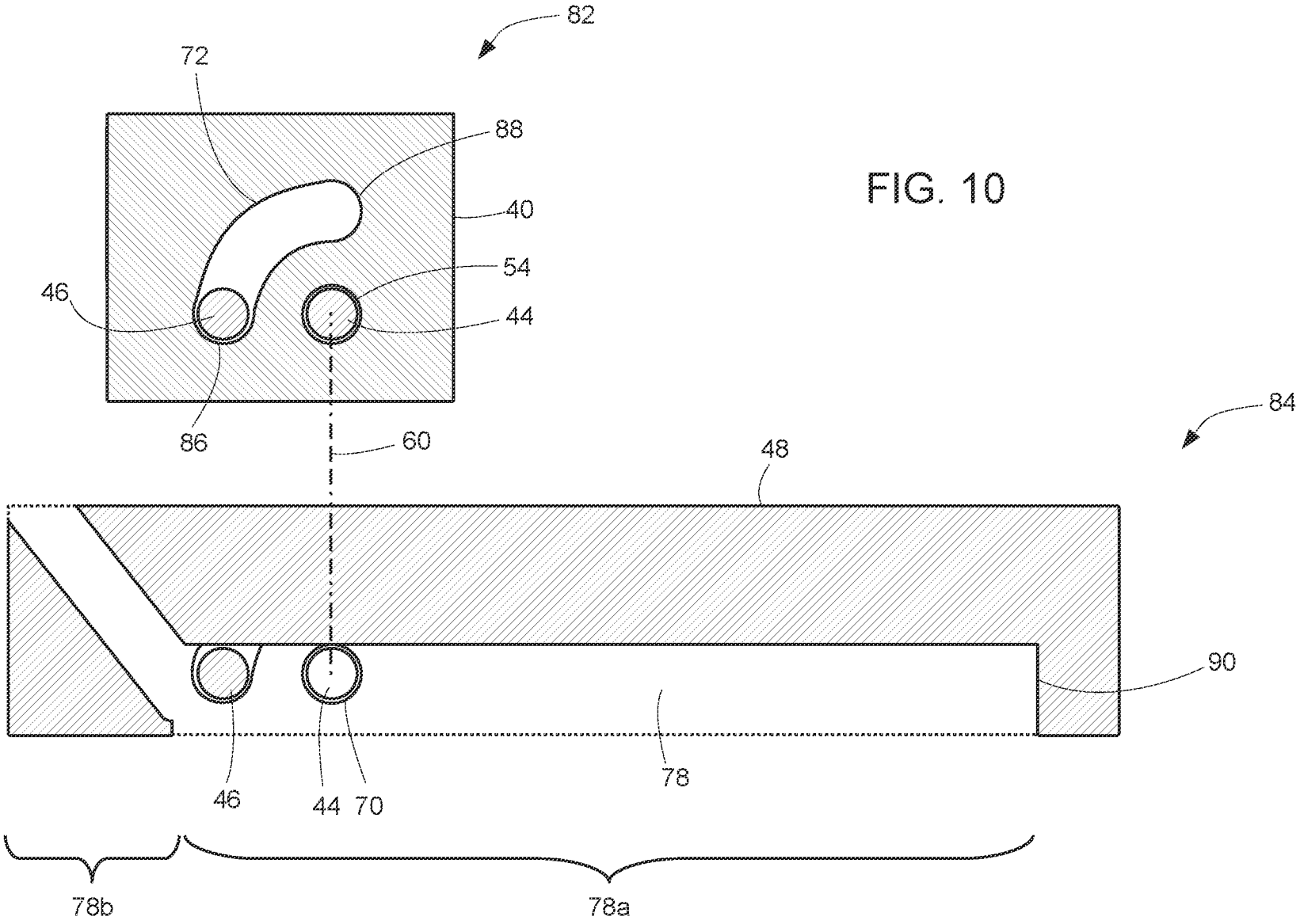
FIG. 10 illustrates a flattened cross-sectional view comparing a first cross section through the C-slot of the cylindrical body and a second cross section through the channel illustrating the relative positions of the lever pin in the C-slot and the channel while the cradle is in the storage position according to an exemplary embodiment.

FIG. 10 illustrates a flattened cross-sectional view comparing a first cross section 82 through the C-slot 72 of the cylindrical body 40 and a second cross section 84 through the channel 78 illustrating the relative positions of the lever pin 46 in the C-slot 72 and the channel 78 while the cradle 30 is in the storage position according to an exemplary embodiment. The diagrams of FIG. 10 and also FIG. 11, described next, are flattened meaning the curvature of the cylindrical body 40 of the inner mechanism 38 and the channel 78 around the center axis 22 is removed. Both cross sections 82, 84 are taken facing toward the center of axis 22 and the cradle axis of the rotation 60 passes lengthwise through the center of the pivot pin 44.

As shown in FIG. 10, the channel 78 is formed by two portions: a first portion 78*a* where the channel substantially is flat (horizontal—0 degrees) and a second portion 78*b* where the channel is angled upwards. The first portion 78*a* of the channel 78 is much longer than the second portion 78*b* and acts to hold the lever pin 46 down such that the lever pin 46 is positioned at the bottom end 86 of the C-slot 72. When the base 16 and shell 18 are rotated relative to one another such that the relative positions of the C-slot 72 and the channel 78 are as illustrated in FIG. 10, the force exerted on the lever pin 46 by the channel 78 acts to rotate the cradle 30 such that it is in the storage position as illustrated in FIG. 6.

Figure 11:
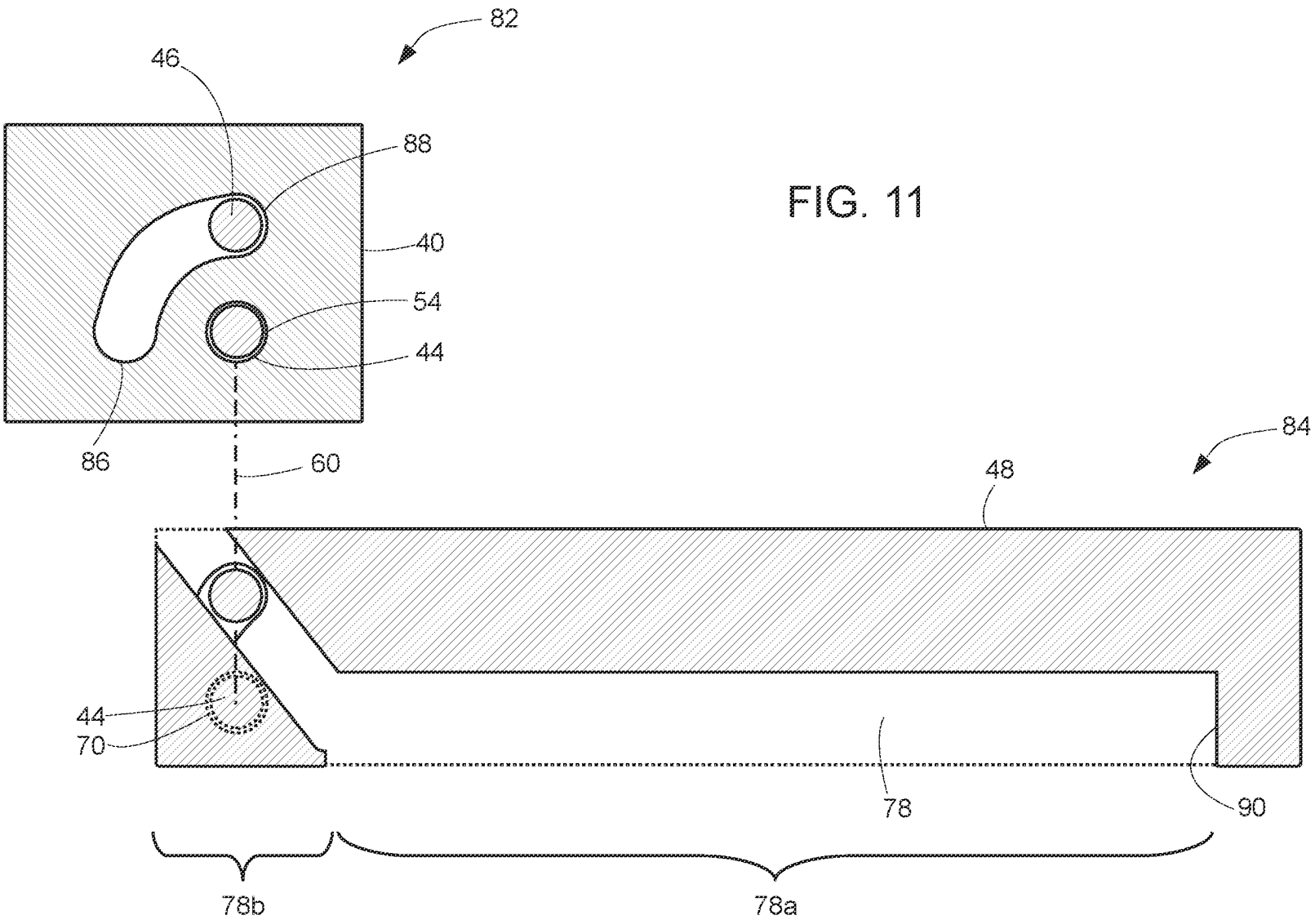
FIG. 11 illustrates a flattened cross-sectional view comparing the first cross section through the C-slot 72 of the cylindrical body and the second cross section through the channel illustrating the relative positions of the lever pin in the C-slot and the channel while the cradle is in the presentation position according to an exemplary embodiment.

FIG. 11 illustrates a flattened cross-sectional view comparing the first cross section 82 through the C-slot 72 of the cylindrical body 40 and the second cross section 84 through the channel 78 illustrating the relative positions of the lever pin 46 in the C-slot 72 and the channel 78 while the cradle 30 is in the presentation position according to an exemplary embodiment.

As shown in FIG. 11, the second portion 78*b* of the channel 78 acts to push the lever pin 46 upwards such that the lever pin 46 is positioned at the top end 88 of the C-slot 72. When the base 16 and shell 18 are rotated relative to one another such that the relative positions of the C-slot 72 and the channel 78 are as illustrated in FIG. 11, the force exerted on the lever pin 46 by the channel 78 acts to rotate the cradle 30 such that it is in the presentation position as illustrated in FIG. 5.

As illustrated, the channel 78 guides the lever pin 46 to traverse between different ends 86, 88 of the C-slot 72 based on relative motion between the channel 78 and the C-slot 72 (i.e., relative motion between the shell 18 and the base 16). In this embodiment, most of this relative motion will not actually result in a change to the angle of the cradle 30 because the lever pin 48 will remain within the first portion 78*a* of the channel 78 and thereby stay at the bottom end 86 of the C-slot 72. Only near the end of the relative motion just as the aperture blades 28 are approaching the fully opened position does the second portion 78*b* of the channel 78 come into play to move the lever pin 46 to the top end 88 of the C-slot, thereby rotating the cradle 30 to the presentation position.

In this embodiment, the first portion 78*a* of the channel 78 is much longer than the second portion 78*b*, and the second portion 78*b* is only near the end of the channel 78. This structure means that the cradle rotation only occurs when the iris diaphragm formed by the actuatable member 14 is generally opened. In this way, a ring 12 or other object mounted on the top side 34 of the cradle 30 will generally not impact or otherwise impede operation of the aperture blades 28 opening and closing.

Figure 12:
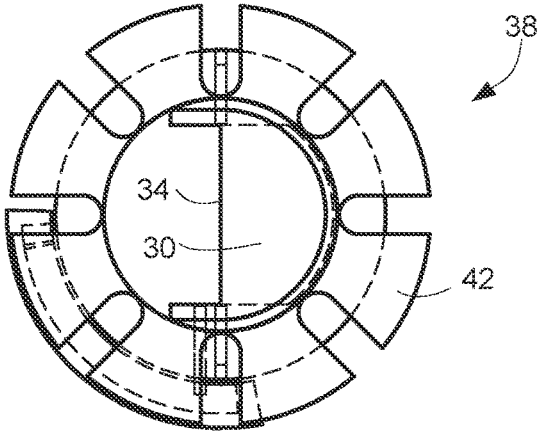
FIG. 12 illustrates a top view of the inner mechanism while the actuatable member is in a fully closed position and the cradle is in the storage position according to an exemplary embodiment.
Figure 13:
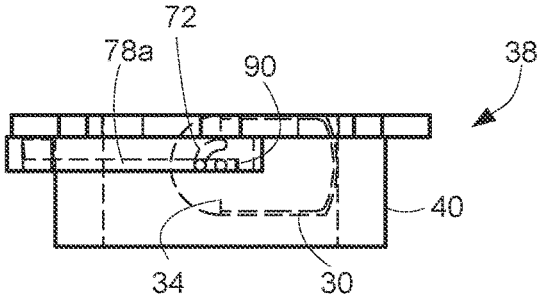
FIG. 13 illustrates a side view of the channel against the inner mechanism while the actuatable member is in a fully closed position and the cradle is in the storage position according to an exemplary embodiment.
Figure 14:
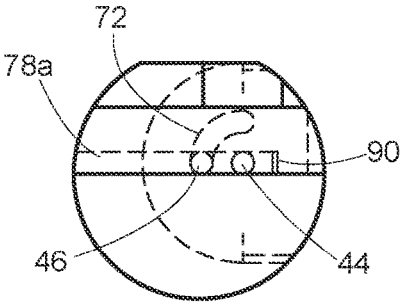
FIG. 14 illustrates a zoomed-in side view showing the lever pin position within the C-slot as controlled by the channel while the actuatable member is in a fully closed position and the cradle is in the storage position according to an exemplary embodiment.

FIGS. 12, 13, and 14 respectfully illustrate a top view of the inner mechanism 38, a side view of the channel 72 against the inner mechanism 38, and a zoomed-in side view showing the lever pin 46 position within the C-slot 72 as controlled by the channel 78 while the actuatable member 14 is in a fully closed position and the cradle 30 is in the storage position. The relative motion between the base 16 and the shell 18 is such that the lever pin 46 is positioned in the first portion 72*a* of the channel near a first end 90 of the channel 78. At this relative position between the channel and the cylindrical body, the channel holds the lever pin to the bottom of the C-slot and the cradle is thereby pivoted to the storage position. As explained further below, at this position, the actuatable member moves the blades such that the iris diaphragm is in a fully closed position.

Figure 15:
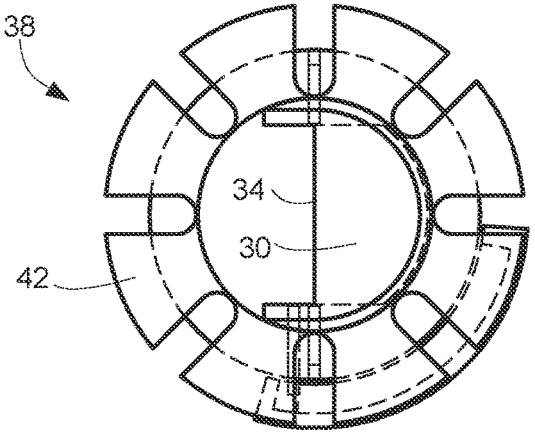
FIG. 15 illustrates a top view of the inner mechanism while the actuatable member is in a partially opened position and the cradle remains in the storage position according to an exemplary embodiment.
Figure 16:
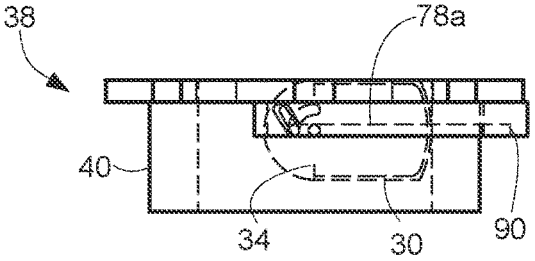
FIG. 16 illustrates a side view of the channel against the inner mechanism while the actuatable member is in a partially opened position and the cradle remains in the storage position according to an exemplary embodiment.
Figure 17:
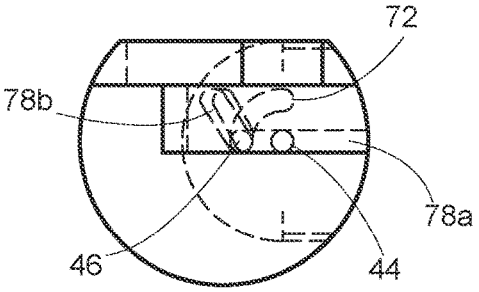
FIG. 17 illustrates a zoomed-in side view showing the lever pin position within the C-slot as controlled by the channel while the actuatable member is in a partially opened position and the cradle remains in the storage position according to an exemplary embodiment.

FIGS. 15, 16, and 17 respectfully illustrate a top view of the inner mechanism 38, a side view of the channel 78 against the inner mechanism 38, and a zoomed-in side view showing the lever pin 46 position within the C-slot 72 as controlled by the channel 72 while the actuatable member 14 is in a partially opened position and the cradle 30 remains in the storage position. The relative motion between the base 16 and the shell 18 is such that the lever pin 46 is still positioned in the first portion of the channel 78*a*—i.e., the lever pin 46 is moved to be adjacent to but not yet within the second portion 78*b* of the channel 78. At this relative position between the channel 78 and the cylindrical body 40, the channel 78 still holds the lever pin 48 to the bottom of the C-slot 72 and the cradle 30 is thereby pivoted in the storage position. However, as explained below, the actuatable member 14 moves the blades 28 such that the iris diaphragm occluding the aperture 26 is almost fully opened.

Figure 18:
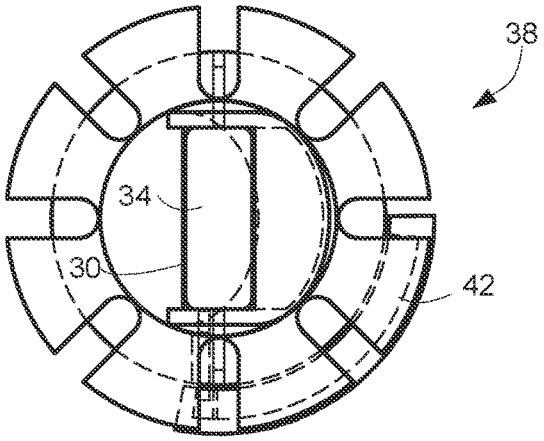
FIG. 18 illustrates a top view of the inner mechanism while the actuatable member is in a partially opened position and the cradle is being rotated between the storage position and the presentation position according to an exemplary embodiment.
Figure 19:
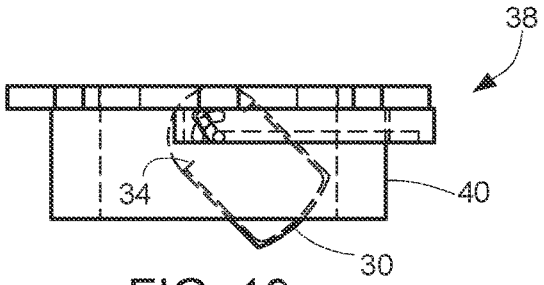
FIG. 19 illustrates a side view of the channel against the inner mechanism while the actuatable member is in a partially opened position and the cradle is being rotated between the storage position and the presentation position according to an exemplary embodiment.
Figure 20:
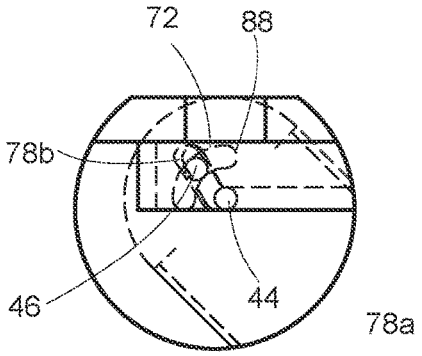
FIG. 20 illustrates a zoomed-in side view showing the lever pin position within the C-slot as controlled by the channel while the actuatable member is in a partially opened position and the cradle is being rotated between the storage position and the presentation position according to an exemplary embodiment.

FIGS. 18, 19, and 20 respectfully illustrate a top view of the inner mechanism 38, a side view of the channel 78 against the inner mechanism 38, and a zoomed-in side view showing the lever pin 46 position within the C-slot 72 as controlled by the channel 78 while the actuatable member 14 is in a partially opened position and the cradle 30 is being rotated between the storage position and the presentation position. The relative motion between the base 16 and the shell 18 is such that the lever pin 46 is now positioned in the second portion 78*b* of the channel 72—i.e., the portion 78*b* of the channel 72 that is angled upwards as seen in FIG. 20. At this relative position between the channel 78 and the cylindrical body 40, the angled channel 78*b* pushes the lever pin 46 upwards in the C-slot 72 toward (but not yet at) the top end 88 of the C-slot 72. As shown in FIG. 19, the cradle 30 is thereby pivoted to be between the storage position and the presentation position. Again, at this relative position, the actuatable member 14 has moved the blades 28 such that the iris diaphragm is almost fully opened. A ring 12 or other object that may be mounted on the top side of the cradle 30 neither blocks nor is blocked by the aperture blades 28. A user can also thereby see into the aperture 26 to observe the rotation of the cradle 30 occurring, which adds to the accentuation of the presentation of the object 12.

Figure 21:
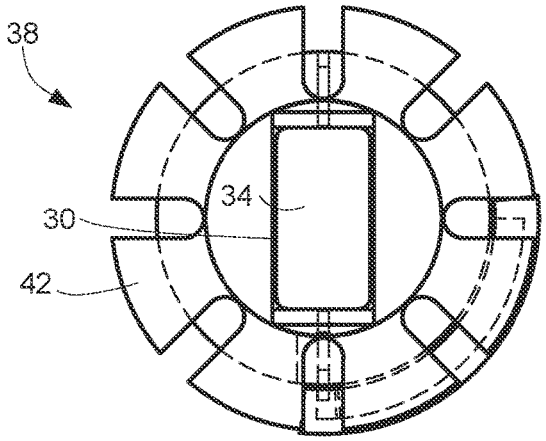
FIG. 21 illustrates a top view of the inner mechanism while the actuatable member is in the opened position and the cradle is in the presentation position according to an exemplary embodiment.
Figure 22:
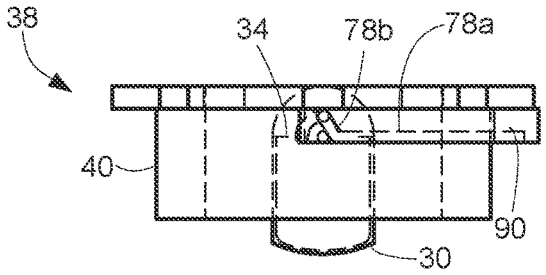
FIG. 22 illustrates a side view of the channel against the inner mechanism while the actuatable member is in the opened position and the cradle is in the presentation position according to an exemplary embodiment.
Figure 23:
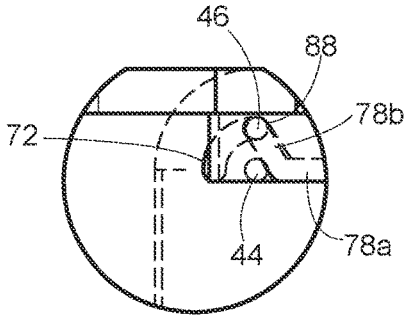
FIG. 23 illustrates a zoomed-in side view showing the lever pin position within the C-slot as controlled by the channel while the actuatable member is in the opened position and the cradle is in the presentation position according to an exemplary embodiment.

FIGS. 21, 22, and 23 respectfully illustrate a top view of the inner mechanism 38, a side view of the channel 78 against the inner mechanism 38, and a zoomed-in side view showing the lever pin 46 position within the C-slot 72 as controlled by the channel 78 while the actuatable member 14 is in the opened position and the cradle 30 is in the presentation position. The relative motion between the base 16 and the shell 18 is such that the lever pin 46 is now positioned near an end of the second portion 78*b* of the channel 78. At this relative position between the channel 72 and the cylindrical body 40, the angled second portion 78*b* of the channel 78 pushes the lever pin 46 to the top end 88 of the C-slot 72. As shown in FIG. 22, the cradle 30 is thereby pivoted fully to the presentation position. At this relative position, the actuatable member 14 has also moved the blades 28 such that the iris diaphragm is fully opened. The object 12 mounted on the top surface 34 of the cradle 30 is thereby presented to the user through the aperture 26.

Figure 25:
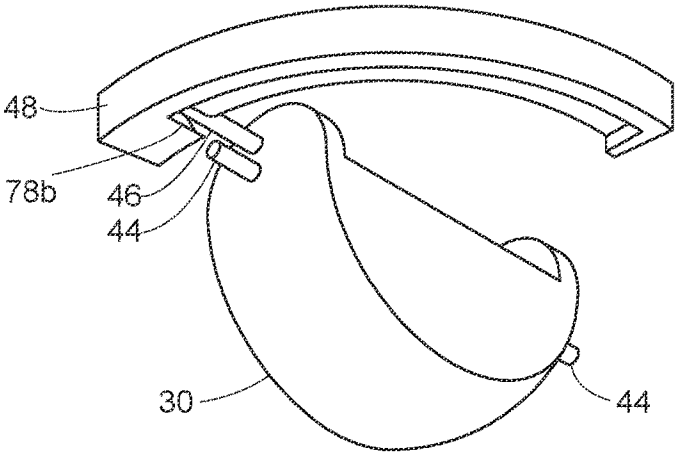
FIG. 25 illustrates a second perspective view of the lever pin of the cradle being driven by the channel around the pivot pin such that the cradle is rotated to face upwards in the presentation position according to an exemplary embodiment.
Figure 24:
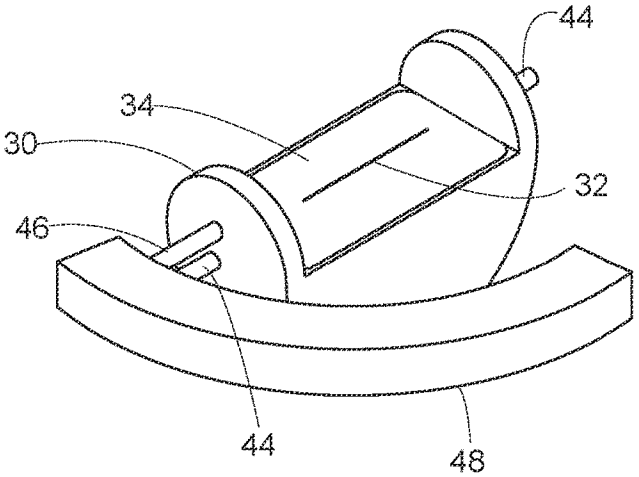
FIG. 24 illustrates a first perspective view of the lever pin of the cradle being driven by the channel around the pivot pin such that the cradle is rotated to face upwards in the presentation position according to an exemplary embodiment.
Figure 26:
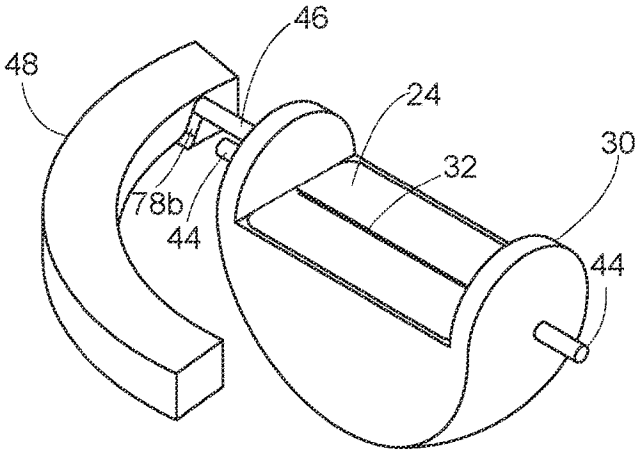
FIG. 26 illustrates a third perspective view of the lever pin of the cradle being driven by the channel around the pivot pin such that the cradle is rotated to face upwards in the presentation position according to an exemplary embodiment.

FIGS. 24 to 29 show various perspective views of the interplay between the relative positions of the lever pin 46, channel 78, and pivot pin 44 of the cradle 30 in presentation and open positions according to an exemplary embodiment. FIGS. 24-26 show how the lever pin 46 is pivoted by the second channel portion 78*b* such that the cradle 30 is rotated into in the presentation position and FIGS. 27-30 show how the lever pin 46 is pivoted by the first channel portion 78*a* such that the cradle 30 is rotated into the storage position.

In particular, FIG. 24 illustrates a first perspective view of the lever pin 46 of the cradle 30 being driven by the second channel portion 78*b* to be above the pivot pin 44 such that the cradle 30 is rotated to face upwards in the presentation position as seen from above the cradle 30, and FIG. 25 illustrates a second perspective view of the lever pin 46 of the cradle 30 being driven by the second channel portion 78*b* to be above the pivot pin 44 such that the cradle 30 is rotated to face upwards in the presentation position as seen from below the cradle 30. As illustrated, moving the lever pin 46 by the second channel portion 78*b* on the channel member 48 such that the lever pin 46 is positioned vertically above the pivot pin 44 results in the cradle 30 being rotated into the presentation position. In the presentation position, the top side 34 of the cradle 30 including the slit 32 for attaching an object 12 such as a ring faces toward the center of the opened iris aperture 26 formed by the aperture blades 28.

FIG. 26 illustrates a third perspective view of the lever pin 46 of the cradle 30 being driven by the channel 78 to be above the pivot pin 44 such that the cradle 30 is rotated to face upwards in the presentation position. As seen in FIG. 26, the lever pin 46 is within the second, angled portion 78*b* of the channel 78 such that the lever pin 46 is above the pivot 44.

Figure 27:
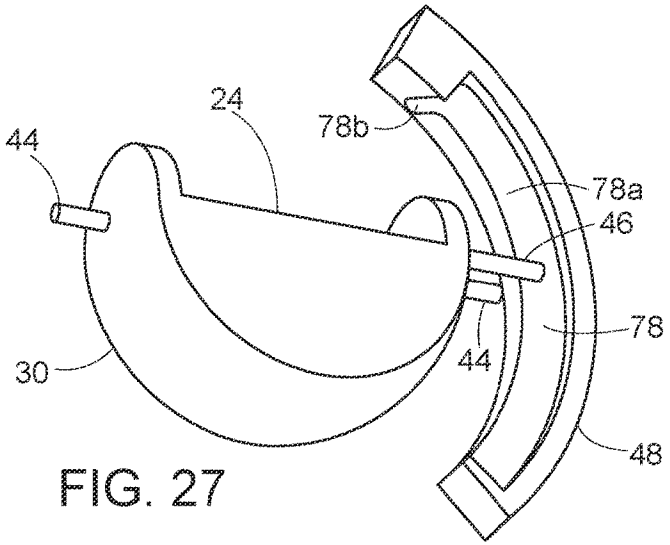
FIG. 27 illustrates a first perspective view of the lever pin of the cradle being driven by the channel around the pivot pin such that the cradle is rotated to face sideways in the storage position according to an exemplary embodiment.
Figure 29:
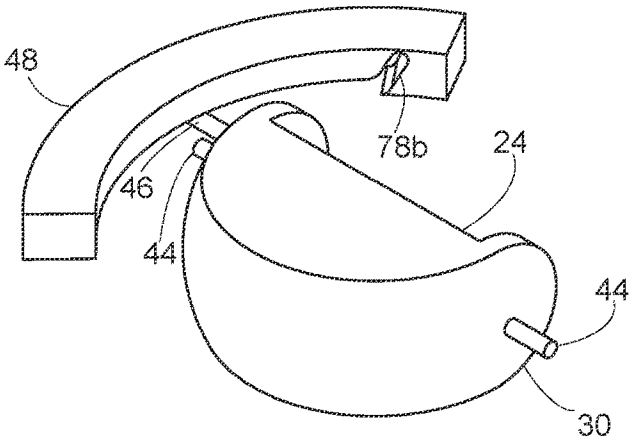
FIG. 29 illustrates a third perspective view of the lever pin of the cradle being driven by the channel around the pivot pin such that the cradle is rotated to face sideways in the storage position according to an exemplary embodiment.
Figure 28:
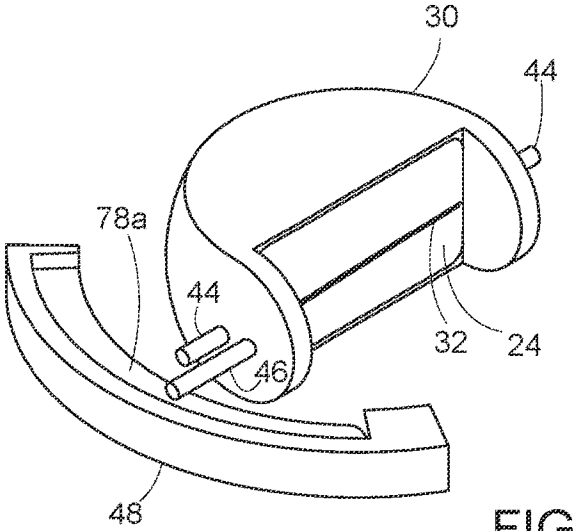
FIG. 28 illustrates a second perspective view of the lever pin of the cradle being driven by the channel around the pivot pin such that the cradle is rotated to face sideways in the storage position according to an exemplary embodiment.

FIG. 27 illustrates a perspective view of the lever pin 46 being pivoted by the channel 78 around the pivot pin 44 to thereby rotate the cradle 30 to be in the storage position. FIG. 28 and FIG. 29 show additional perspective views of the first channel portion 78*a* moving the lever pin 46 relative to the pivot pin 44 thereby ensuring the cradle 30 is pivoted to the storage position.

Figure 32:
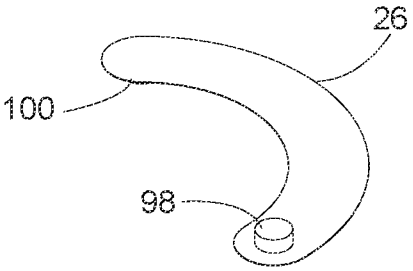
FIG. 32 illustrates a first side of an aperture blade including a protrusion according to an exemplary embodiment.
Figure 31:
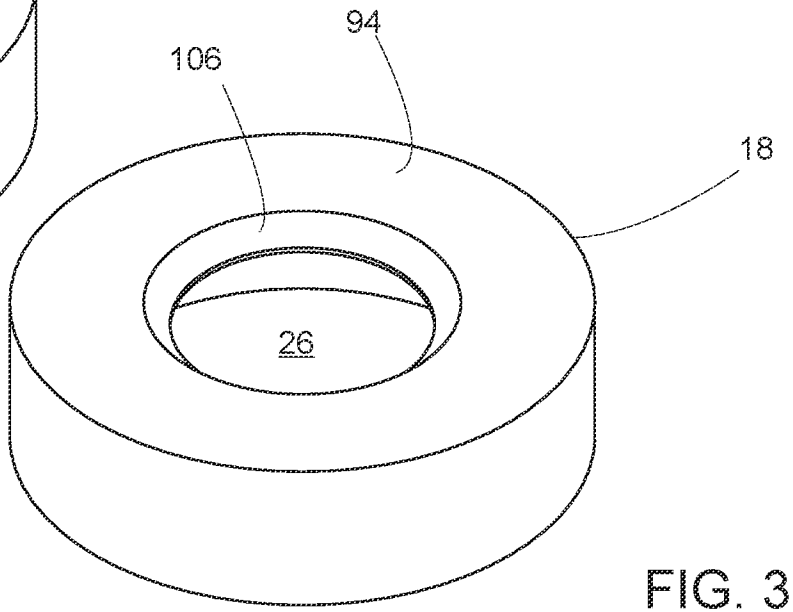
FIG. 31 shows a second perspective view of the shell showing the topside of the shell according to an exemplary embodiment.
Figure 30:
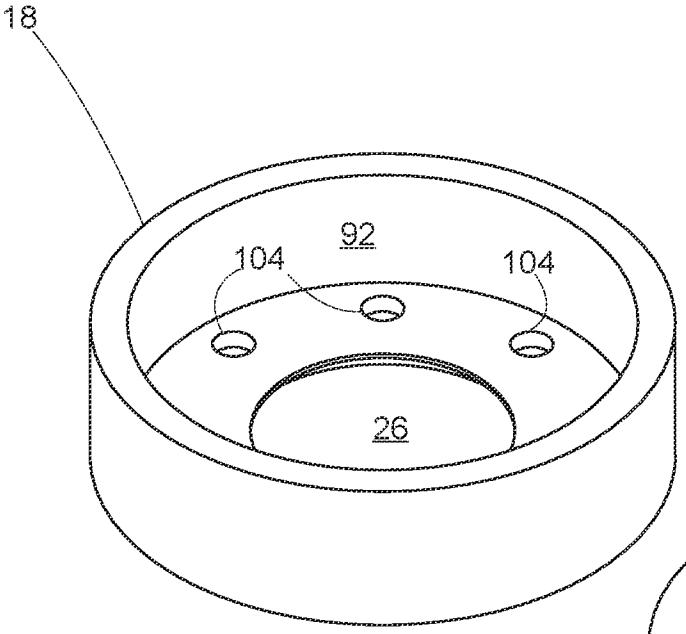
FIG. 30 shows a first perspective view of the shell showing the underside of the shell according to an exemplary embodiment.

FIG. 30 shows a first perspective view of the shell 18 showing the underside 92 of the shell 18. Likewise, FIG. 31 shows a second perspective view of the shell 18 showing the topside 94 of the shell 18. For completeness, FIG. 32 illustrates a first side 96 of an aperture blade 28 including a protrusion 98—although not illustrated, the aperture blade 28 flipped over generally looks the same; however, the protrusion 98 is on the other end 100 of the blade 28. Each of the aperture blades 28 acts as an actuatable member 14 that moves between a closed position in which the blade 28 at least partially occludes the aperture 26, and an open position in which the blade 28 does not occlude at least part of the aperture 28. Together, a plurality of aperture blades 28 creates the iris diaphragm that opens and closes in accordance with the relative motion between the base 16 and shell 18.

Operation of the iris in some embodiments is similar to as described in the inventor's prior U.S. Pat. No. 10,315,836, granted on Jun. 11, 2019, and entitled "METHODS, USES, AND APPARATUS FOR PRESENTING AND STORING OBJECTS" (hereinafter "the '836 patent"), which is incorporated herein by reference. Briefly described, as shown in FIG. 8, the inner mechanism 38 comprises an annulus 42 around the central axis 22 and extending from an end 68 of the cylindrical body opposite the base 16. The annulus 42 encircles the aperture 26 and has a plurality of radial tracks 102. An actuatable member 14 is formed by a plurality of aperture blades 28, each with a first and second protrusions 98. The first projection 98 of each of the aperture blades 28 is rotatably connected to the shell 18 at a point adjacent to the aperture (see connection points 104 on the underside 92 of the shell 18 in FIG. 30) and the second projection 98 of each of the aperture blades 28 is translatable within a radial track 102 of the plurality of radial tracks 104 on the annulus 42 (see tracks 102 of annulus 42 in FIG. 8). In this way, the plurality of aperture blades 28 define an iris diaphragm that has an iris opening when the relative motion between base 16 and shell 18 drives the blades 28 into the open position that is larger than any iris opening that occurs when the blades 28 are driven to the closed position.

When the base 16 is rotated relative to the shell 18 in a first direction, relative positions of the actuatable member 14 and the shell 18 drive the aperture blades 28 to decreasingly occlude the aperture 26. In other words, the iris diaphragm closes. When the base 16 is rotated relative to the shell 18 in a second direction, relative positions of the actuatable member 14 and the shell 18 drive the aperture blades 28 to increasingly occlude the aperture—i.e., the iris diaphragm opens.

A plurality of eight aperture blades 28 is utilized in some embodiments to provide a good balance of tighter iris in the closed position and an interesting opening/closing effect.

As shown in FIGS. 30 and 31, the top side 24 of the shell 18 includes a chamfered edge 106 that defines the aperture 26. In some embodiments, the shell 18 and/or base 16 is/are at least partially made of wood. In some embodiments, the shell 18 and/or base 16 is/are at least partially made of aluminum. The shell 18 and the base 16 are each independently rotationally symmetric about the central axis 22. This is achieved in some embodiments by coupling the base 16 and the inner mechanism 38 to an inner race 64 of the ball bearing 36, and further coupling the shell 18 to the outer race 66 of the ball bearing 36 (see FIG. 3). These couplings may be done by epoxy or other adhesive and thereby allow the base 16 and inner mechanism 38 pair to rotate relative to the outer shell 18.

According to an exemplary embodiment, a container 10 includes a base 16 and a shell 18 rotatably coupled to one another. The shell 18 defines an aperture 26 and a cradle 30 is rotatably mounted therein. The top 34 of the cradle 30 holds an object 12 and the cradle 30 is pivotable between presentation and storage positions. An actuatable member 14 is movable to open or occlude the aperture 26. Rotation of the base 16 relative to the shell 18, in a first direction, drives the actuatable member 14 towards an open position and pivots the cradle 30 towards the presentation position, and rotation in a second direction drives the actuatable member 14 towards a closed position and pivots the cradle 30 towards the storage position. A lever pin 46 on the cradle 30 extends through a C-slot 72 of an inner mechanism 38 rotating with the base 16 to a channel 78 on the shell. Rotation between the base 16 and shell 18 causes the channel 78 to drive the lever pin 46 to different ends 86, 88 of the C-slot 72 to thereby pivot the cradle 30.

Exemplary benefits of some embodiments include a thinner container 10 than that provided by the above-mentioned '836 patent. In particular, whereas the '836 patent only raises and lowers a carriage between a presentation position and a storage position, containers 10 according to some embodiments disclosed herein instead pivot a cradle 30 between presentation and storage positions. Pivoting of a cradle 30 as disclosed here can allow for making the shell 18 and inner mechanisms 38 having vertical heights that are not as tall as are required for the up and down motion of carriage in the '836 patent. In this way, containers 10 as disclosed herein that only pivot the cradle 30 may be particularly beneficially to situations such as surprise proposals where the container 10 needs to stay concealed in a pocket until the moment of proposal.

Although the invention has been described in connection with preferred embodiments, it should be understood that various modifications, additions and alterations may be made to the invention by one skilled in the art without departing from the spirit and scope of the invention.

For example, although the above description has focused on a container 10 that only pivots the cradle 30 between the presentation and storage positions, other embodiments are also possible. For instance, in some embodiments, both the lifting and lowering motions of carriage of the '836 patent and the pivoting motion disclosed herein are simultaneously imparted to the cradle 30. FIGS. 33 to 38 illustrate one embodiment for achieving this effect. In general, the first portion 78*a* of the channel 78 is changed to be angled upwards before reaching a second portion 78*b* of the channel 78 that abruptly changes directly of the lever pin 46.

Figure 33:
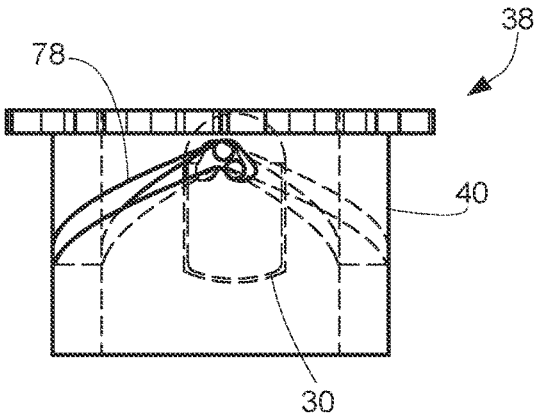
FIG. 33 illustrates a side view of the channel against the inner mechanism while the actuatable member is in a fully opened position and the cradle is both pivoted and raised to the presentation position according to an exemplary embodiment.
Figure 34:
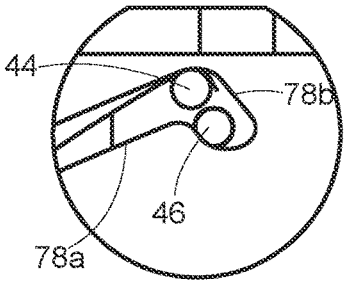
FIG. 34 illustrates a zoomed-in side view showing the relative pivot pin and lever pin positions controlled by the channel while the actuatable member is in a fully opened position and the cradle is both pivoted and raised to the presentation position according to an exemplary embodiment.

To help explain the concept, FIGS. 33 and 34 respectfully illustrate a side view of the channel 78 against the inner mechanism 38 and a zoomed-in side view showing the relative pivot pin 44 and lever pin 46 positions controlled by the channel 78 while the actuatable member 14 is in a fully opened position and the cradle 30 is moved to the presentation position. As shown in FIG. 33, the cradle 30 is both pivoted by the relative pivot pin 44 and lever pin 46 positions to be in the presentation position and is further raised upward by the first channel portion 78*a* to be proximal to the aperture 26 in this presentation position. At this position, the actuatable member 14 has moved the blades 28 such that the iris diaphragm is fully opened. A ring 12 or other object that may be mounted on the top side 34 of the cradle 30 thereby neither blocks nor is blocked by the aperture blades 28. A user can also thereby see into the aperture 26 to see both the rotation and the vertical movement of the cradle 30 occurring, which adds to the accentuation of the presentation of the object 12.

Figure 35:
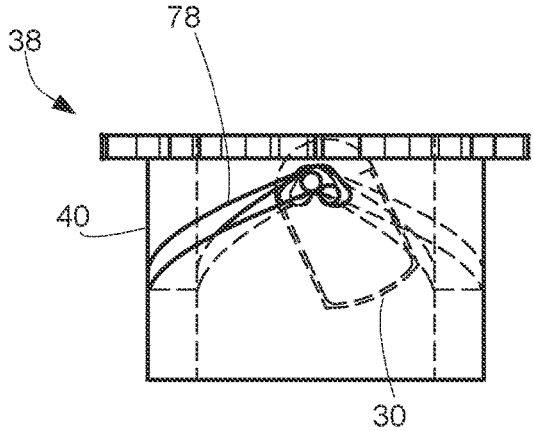
FIG. 35 illustrates a side view of the channel against the inner mechanism while the actuatable member is in a partially opened position and the cradle is pivoted between the presentation and storage positions and being moved vertically according to an exemplary embodiment.
Figure 36:
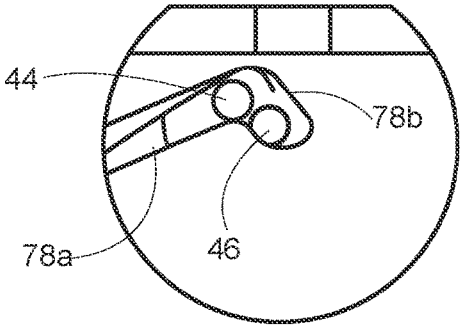
FIG. 36 illustrates a zoomed-in side view showing the relative pivot pin and lever pin positions controlled by the channel while the actuatable member is in a partially opened position and the cradle is pivoted between the presentation and storage positions and being moved vertically according to an exemplary embodiment.

FIGS. 35 and 36 respectfully illustrate a side view of the channel 78 against the inner mechanism 38 and a zoomed-in side view showing the relative pivot pin 44 and lever pin 46 positions controlled by the channel 78 while the actuatable member 14 is in a partially opened position and the cradle 30 is pivoted between the presentation and storage positions. As shown in FIG. 35, right as the relative motion between the base 16 and the shell 18 starts to occur in the direction required to close the aperture 26, the cradle 30 is immediately pivoted by the relative pivot and lever pin 44, 46 positions toward the storage position. At this position, the actuatable member 14 has just barely started to move the blades 28 from the open position such that the iris diaphragm is only beginning to close.

Figure 37:
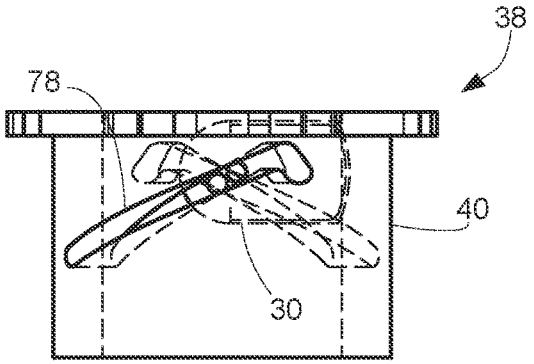
FIG. 37 illustrates a side view of the channel against the inner mechanism while the actuatable member is in a partially closed position and the cradle is pivoted into the storage position while being moved vertically according to an exemplary embodiment.
Figure 38:
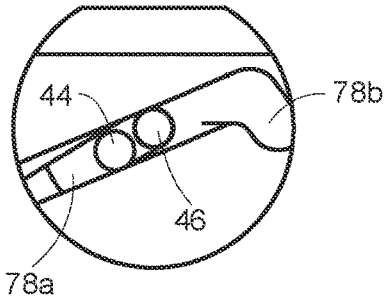
FIG. 38 illustrates a zoomed-in side view showing the relative pivot pin and lever pin positions controlled by the channel while the actuatable member is in a partially closed position and the cradle is pivoted into the storage position while being moved vertically according to an exemplary embodiment.

FIGS. 37 and 38 respectfully illustrate a side view of the channel 78 against the inner mechanism 38 and a zoomed-in side view showing the relative pivot pin 44 and lever pin 46 positions controlled by the channel 78 while the actuatable member 14 is in a partially closed position and the cradle 30 is pivoted into the storage position. As shown in FIG. 37, the cradle 30 is fully pivoted by the relative pivot and lever pin 44, 46 positions toward the storage position and the cradle 30 is also being lowered down the first portion 78*a* of the channel 78 to become more distal from the aperture 26. At this position, the actuatable member 14 has partially closed the iris blades.

Figure 39:
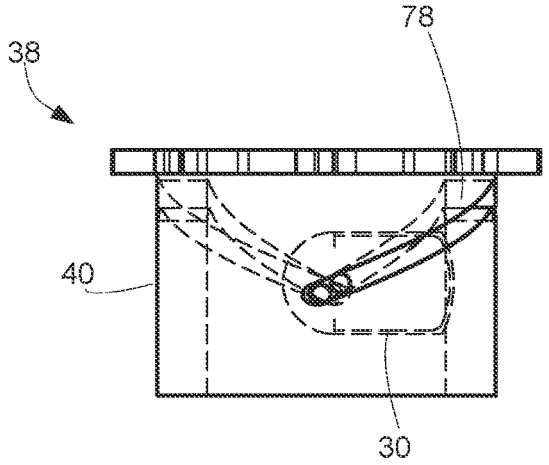
FIG. 39 illustrates a side view of the channel against the inner mechanism while the actuatable member is in a fully closed position and the cradle is pivoted into the storage position and moved to be distal to the aperture according to an exemplary embodiment.
Figure 40:
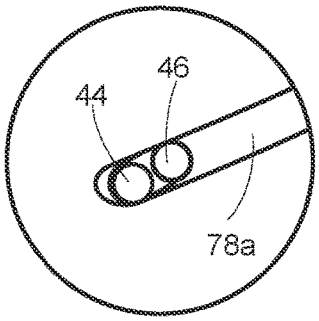
FIG. 40 illustrates a zoomed-in side view showing the relative pivot pin and lever pin positions controlled by the channel while the actuatable member is in a fully closed position and the cradle is pivoted into the storage position and moved to be distal to the aperture according to an exemplary embodiment.

Lastly, FIGS. 39 and 40 respectfully illustrate a side view of the channel 78 against the inner mechanism 38 and a zoomed-in side view showing the relative pivot pin 44 and lever pin 46 positions controlled by the channel 78 while the actuatable member 14 is in a fully closed position and the cradle 30 is pivoted into the storage position. As shown in FIG. 39, the cradle remains fully pivoted by the relative pivot and lever pin 44, 46 positions to the storage position and the cradle 30 is also lowered fully down the first portion 78*a* of the channel 78 to be a maximum distance from the aperture 26. At this position, the actuatable member 14 has fully closed the iris blades 28.

As illustrated, in some embodiments, the cradle 30 is both pivoted and translated in position proximate to the aperture 26. The presentation position has the cradle 30 rotated such that its top side 34 (with object 12 mounting means thereon) faces toward the aperture 26 and further has the cradle 30 moved to be proximal to the aperture 26. The storage position has the cradle 30 rotated such that its top side 34 does not face the aperture 26 and further has the cradle 30 moved to be distal to the aperture 26.

Although the C-slots 72 and/or channels 78 described above act to rotate the cradle 30 ninety degrees between the presentation and storage positions, other embodiments have different angles. For instance, the storage position of the cradle 30 may be rotated to be sixty degrees or even one-hundred and eighty degrees from the presentation position in other embodiments.

Additional components may also be added such as light emitting diodes (LEDs), other lights, battery, and a switch. For instance, in some embodiments, the container 10 includes a light that is turned on and off by a switch that opens and closes based on the relative rotation of the base and shell. The light may be located within the interior volume 50 of the container 10 or may be within the cradle 30 itself, for example. In some embodiments, the switch is closed to complete an electrical circuit between the light and battery to thereby illuminate the cradle 30 and object 12 thereon while the lever pin 46 is traversing the second portion 78*b* of the channel 78. In this way, the light turns on so the user can see the pivot action of the cradle 30 and turns off otherwise to save batteries such as when the container 10 is in storage.

Although the above examples have illustrated the container 10 holding a personal ornament 12 being an engagement ring, this is only one application of the container 10. The size and dimensions of the container 10 can be adjusted as needed to accommodate any type of object 12 to be stored therein and presented upon opening the container 10. Examples of objects 12 that may be stored and presented utilizing a container 10 as disclosed herein include rings, bracelets, brooches, jewels, pendants, watches, necklaces, and the like. Further, although the above examples have shown the container 10 being cylinder shaped, other embodiments are also possible where the container 10 has different shapes such as being square, octagonal, etc.

Although the actuatable member 14 is described as being formed by a plurality of aperture blades 28 that form an overlapping iris, other types of designs may also be utilized such as non-overlapping irises where the blades 28 do not overlap, for example.

Functions of single components may be separated into multiple components, or the functions of multiple components may be combined into a single component. For example, although the channel 78 is described above as being provided on a curved member 48 that is attached to the shell 18 utilizing an adhesive, in other embodiments the channel 78 is formed on an inside wall 92 of the shell 18. For instance, the channel 78 may be milled into the side of the shell 18 or may be formed during manufacture of the shell 18 utilizing a plastic injection molding process.

Although the object 12 to be stored and presented utilizing the container 10 is described to be attached to the top side 34 of the cradle 30 utilizing a slit 32, other attachment means are also possible. For instance, means for removably attaching the object to the top side of the cradle may includes slits, groves, snaps, clips, magnets, spring-loaded locks, miniature shackles, etc.

All combinations and permutations of the above described features and embodiments may be utilized in conjunction with the invention.

What is claimed is:

1. An apparatus for presenting and storing an object, the apparatus comprising:

a base;

a shell with a first end and a second end, wherein the first end is rotatably coupled to the base such that the shell is rotatable relative to the base about a central axis, and the second end defines an aperture about the central axis opposite to the base;

a cradle rotatably mounted within the shell and having a top side including means for removably attaching the object to the top side of the cradle, wherein the cradle is pivotable between a presentation position where the top side of the cradle faces toward the aperture and a storage position where the top side of the cradle does not face toward the aperture; and an actuatable member adjacent the aperture and movable between a closed position in which the actuatable member at least partially occludes the aperture, and an open position in which the actuatable member does not occlude at least part of the aperture;

wherein, rotation of the base relative to the shell, in a first direction, drives the actuatable member towards the open position and pivots the cradle towards the presentation position, and wherein rotation of the base relative to the shell, in a second direction, drives the actuatable member towards the closed position and pivots the cradle towards the storage position.

2. The apparatus of claim 1, further comprising an inner mechanism within the shell, the inner mechanism having a cylindrical body fixed in position relative to the base such that the cylindrical body is rotatable with the base relative to the shell about the central axis.

3. The apparatus of claim 2, wherein:

the cradle includes a pivot pin extending from a first side that defines a cradle axis around which the cradle is rotatable; and the cradle further includes a lever pin extending from the first side parallel to the pivot pin and off the cradle axis.

4. The apparatus of claim 3, wherein:

the cylindrical body has a pivot hole;

the pivot pin of the cradle is rotatably held captive within the pivot hole;

the cylindrical body further has a C-slot defining an arc around the pivot hole; and the lever pin of the cradle extends into the C-slot and is moveable along the arc defined by the C-slot.

5. The apparatus of claim 4, further comprising:

a channel fixed in position relative to the shell;

wherein the lever pin of the cradle extends into the channel and is translatable within the channel.

6. The apparatus of claim 5, wherein the channel is shaped such that:

when the base is rotated relative to the shell in the first direction, the channel drives the lever pin to a first end of the C-slot thereby pivoting the cradle around the cradle axis to the presentation position; and when the base is rotated relative to the shell in the second direction, the channel drives the lever pin to a second end of the C-slot thereby pivoting the cradle around the cradle axis to the closed position.

7. The apparatus of claim 6, wherein:

the channel has a predetermined length along which the lever pin traverses during rotation of the base relative to the shell in the first direction from the storage position to the presentation position;

the channel includes a first channel portion starting from a first end of the channel, the first channel portion holding the lever pin at the second end of the C-slot for a majority of the predetermined length thereby causing the cradle to stay pivoted in the closed position while the lever pin is within the first channel portion; and the channel includes a second channel portion being shorter in length than the first channel portion, the second channel portion being angled to thereby push the lever pin to the first end of the C-slot as the lever pin moves to a second end of the channel thereby causing the cradle to pivot into the presentation position at an end of rotation of the base relative to the shell in the first direction.

8. The apparatus of claim 5, wherein the channel is a curved member attached to the shell utilizing an adhesive.

9. The apparatus of claim 5, wherein the channel is formed on an inside wall of the shell.

10. The apparatus of claim 2, wherein the inner mechanism comprises an annulus around the central axis and extending from an end of the cylindrical body opposite the base, the annulus encircling the aperture and having a plurality of radial tracks.

11. The apparatus of claim 10, wherein the actuatable member comprises a plurality of aperture blades each with a first projection and a second projection.

12. The apparatus of claim 11, wherein:

the first projection of each of the aperture blades is rotatably connected to the shell at a point adjacent to the aperture; and the second projection of each of the aperture blades is translatable within a radial track of the plurality of radial tracks on the annulus.

13. The apparatus of claim 11, wherein the plurality of aperture blades define an iris diaphragm that has an iris opening in the open position larger than in the closed position.

14. The apparatus of claim 11, wherein:

when the base is rotated relative to the shell in the second direction, relative positions of the actuatable member and the shell drive the aperture blades to increasingly occlude the aperture; and when the base is rotated relative to the shell in the first direction, relative positions of the actuatable member and the shell drive the aperture blades to decreasingly occlude the aperture.

15. The apparatus of claim 10, wherein the plurality of aperture blades comprises eight aperture blades.

16. The apparatus of claim 1, wherein the second end of the shell further comprises a chamfered edge that defines the aperture.

17. The apparatus of claim 1, wherein the shell and the base are each independently rotationally symmetric about the central axis.

18. The apparatus of claim 1, wherein the shell is at least partially made of wood.

19. The apparatus of claim 1, wherein the shell is at least partially made of aluminum.

20. The apparatus of claim 1, wherein:

the cradle is further configured to translate between the presentation position proximal to the aperture and the storage position distal to the aperture;

rotation of the base relative to the shell, in the first direction, further drives the cradle towards the aperture; and rotation of the base relative to the shell, in the second direction, further drives the actuatable member away from the aperture.

* * * * *